US005628403A

United States Patent [19]

Thomas et al.

[11] Patent Number: 5,628,403

[45] Date of Patent: May 13, 1997

[54] UNIVERSAL TURBINE BLADE PACKAGING CONTAINER

[75] Inventors: William A. Thomas, Palm Springs; José L. Ordonez, Van Nuys, both of Calif.

[73] Assignee: Bill Thomas Associates, Inc., Van Nuys, Calif.

[21] Appl. No.: 586,250

[22] Filed: Jan. 16, 1996

[51] Int. Cl.[6] ..... B65D 1/107

[52] U.S. Cl. ..... 206/523; 206/525; 206/560; 206/592; 53/255; 53/446

[58] Field of Search ..... 206/521, 523, 206/591, 592, 593, 594, 525, 349, 335, 560; 53/255, 236, 235, 446, 544

[56] References Cited

U.S. PATENT DOCUMENTS

| | | | |
|---|---|---|---|
| 3,347,353 | 10/1967 | Kline | 206/335 |
| 3,861,531 | 1/1975 | Bellati | 206/523 |
| 5,271,499 | 12/1993 | Van Horssen | 206/335 |

*Primary Examiner*—Paul T. Sewell
*Assistant Examiner*—Luan K. Bui
*Attorney, Agent, or Firm*—Poms, Smith, Lande & Rose

[57] ABSTRACT

A universal airplane jet engine turbine blade packing case assembly for securely holding a matched turbine blade pair of various shapes, sizes, and profiles for safe shipping and storage includes a molded housing having a base and a hinged lid, with the housing being partitioned into two sections, one section for each turbine blade. Each section includes a dial rotatably affixed to the inside of the base, with a tapered slot in the dial for slidably receiving and engaging a turbine blade root when the slot is in a vertical loading position. When the root has been slid into the dial, rotating the turbine blade causes the dial to also rotate, which causes the slot opening to rotate behind a portion of the housing such that the turbine root is now positively held within the dial. The turbine blade and dial are rotated further until the turbine blade chord is aligned vertically in a stow position. The dial has detentes molded into it, such that rotating the dial causes the dial to lock into any one of a number of stow positions to accommodate turbine blades having a variety of root-to-chord angles. In the stow position, when the lid is closed a pair of foam pads securely hold the turbine blade tip by its leading and trailing edges. The assembly allows safe shipping and storage, along with quick packing and unpacking, of a pair of turbine blades of any one of a number of turbine blade models.

18 Claims, 4 Drawing Sheets

FIG. 3
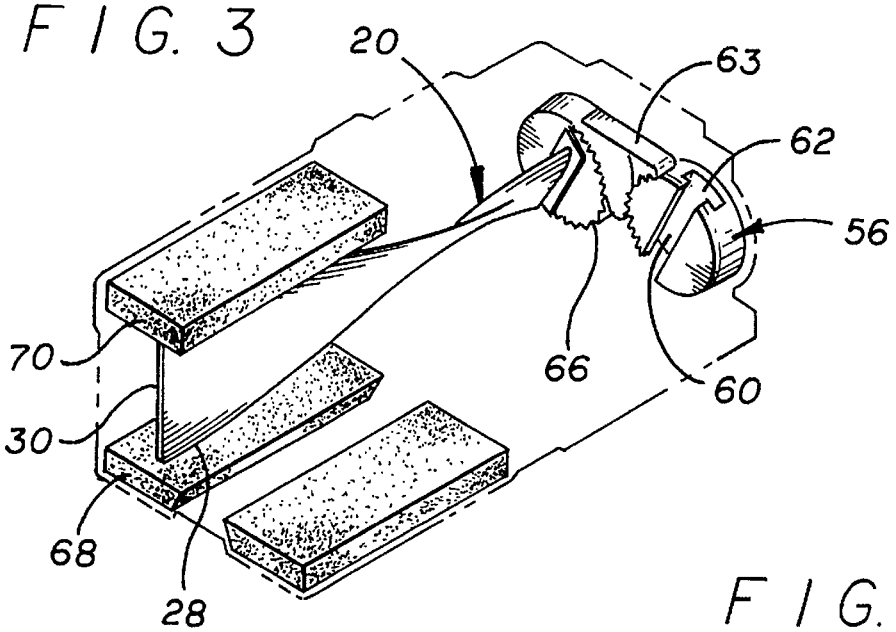
FIG. 4
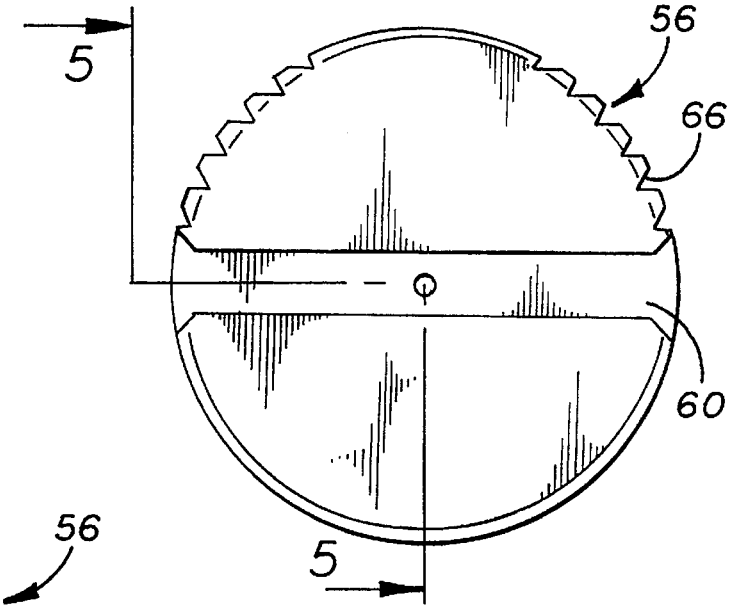
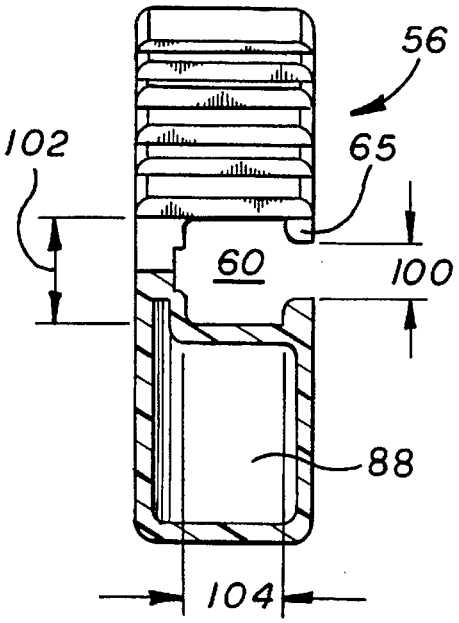
FIG. 5

UNIVERSAL TURBINE BLADE PACKAGING CONTAINER

BACKGROUND OF THE INVENTION

1. Field of the Invention

The present invention relates to the field of airplane parts packaging. More particularly, the present invention relates to the field of turbine blade packaging containers.

2. Description of the Related Art

Airlines carry millions of spare components for unforeseen needs, emergencies, and regular maintenance. Among these spare components are fan blades for the first stage, which represents the first row of blades on modern jet engines. Events such as bird strikes, ice chunks entering the engines during flight, or gravel kicked up from the ground by a landing gear and sucked into an engine can seriously damage a turbine blade, making it necessary to replace the blade. First stage blades are the most prone to such damage. These blades can often be replaced at the line station (terminal). Airlines therefore routinely keep one or two pairs of spare turbine blades at the line stations.

Jet engine fans spin at tremendous speeds, making it imperative that the fan blades be precisely balanced to prevent vibrations. To keep the turbine fans precisely balanced, turbine blades for many jet engines are replaced in pairs. If one blade becomes unserviceable, the damaged blade and the blade opposite it are replaced together. The old blades are replaced with a new pair, with each new blade pair comprising two blades that are matched usually at the factory to have identical weights to within a few grams. To keep the blades properly matched, blade pairs are shipped and stored as pairs. Blade pairs must not only be matched for weight, they must also be matched for dynamic balance. Although a small dent or bend will not change the weight of the blade, it can change the rotational dynamic balance of the blade. Turbine blades must therefore be protected against injuries that otherwise might occur during shipping, storing, and handling. Protecting blades against damage is especially critical in light of the high cost of replacing the blades which are usually made from titanium, the extremely high cost to an airline for every hour that an aircraft is unexpectedly grounded, and the disastrous consequences that could result from installation of an unbalanced fan blade pair.

It is noted in passing that many turbine engines have an even number of blades, and the foregoing statements relating to replacing an opposing pair of blades relates mainly to such engines. However, certain turbine engines have an odd number of blades, and accurately balanced replacement blades for such engines are also important.

Turbine fan blades are irregularly shaped, as can be seen from the illustration of a typical fan blade in FIG. 1. Different fan blade models corresponding to different jet engine models also differ significantly one from another. Fan blades differ in root shapes, platform lengths and widths, blade lengths and widths, chord angles, and midspan sizes and locations. These factors have complicated the development of a suitable packaging container for fan blades.

Packaging containers having foam with recesses that follow the contours of the objects to be shipped are well known within the packaging arts. However, such contoured foam would be expensive to produce in light of the highly irregularly shaped molds that would be required for fan blades. Furthermore, shipping crates lined with foam contoured to one blade model would be unsuitable for shipping a different blade model. While removable foam components could be used, these present the additional risk that such foam components will be lost or misplaced during maintenance operations. Packing "shells" or "peanuts" and the like could be used in the container, but the heavy turbine blades can settle to the bottom of a container filled with such material increasing the possibility that the blade will be damaged during handling. Additionally, packing shells are environmentally wasteful and have a tendency to blow away in even slight breezes and create unsightly conditions. Nestling the blades within various other cushioning substances such as foam blocks or newspaper suffers the drawback of being time consuming to properly and securely pack the fan blade, with the attendant risk that the blades will not always be properly packed.

SUMMARY OF THE INVENTION

It has been recognized that there is a need for a universal turbine blade packing container capable of securely holding a pair of a wide variety of turbine blades for safe shipping and storage, with the blades capable of being secured within and removed from the container quickly and easily.

Accordingly, it is an object of the present invention to provide a shipping and storage case for a matched pair of turbine blades that is capable of securely and safely holding a wide variety of turbine blades.

It is also an object of the invention to provide a turbine blade shipping case in which turbine blades may be quickly and easily packed for storage, and quickly and easily removed.

It is a further object of the present invention to provide a turbine blade shipping case that is economical and lightweight.

It is a still further object of the invention to provide a turbine blade shipping case with no loose parts that can become lost.

To accomplish these and other objects, an illustrative embodiment of the present invention includes a shipping container housing having a base and a lid hinged together. Rotatably affixed to the inside of the housing is a pair of root retainers or dials, each dial having a tapered or stepped slot for slidably receiving turbine blade roots of various profiles. The position in which the slot is vertical, wherein an open slot end is exposed, defines a loading position. When the dial is in its loading position, a turbine blade root may be slid into the slot, so that the turbine blade is held by its root, which is the heaviest part of the blade. Once the blade is inserted within the root, the blade and dial are rotated together until the turbine blade chord is vertical, defining a stow position. In this position, the open slot end in the dial has been rotated so that it is no longer exposed. The dial has bumps or detentes on its outer circumference that engage protrusions that are fixed relative to the housing, such that the dial locks in its rotated position by friction, and the blade root is securely retained within the dial. When the blade has been rotated so that the blade chord is vertical, the lower blade edge rests on a resilient pad such as a foam pad mounted within the housing base. A similar pad is mounted to the lid, such that when the hinged lid is closed the foam pad in the lid compresses down onto the upper blade edge, with the bottom foam pad being similarly compressed against the lower blade edge. Thus, the turbine blade is held securely by the root which is the heaviest portion of the blade, the lower blade edge, and the upper blade edge. The tip of the blade is not touching anything, because the internal space within the housing is longer than is the blade. The blade may be shipped safely in this position, along with its matching blade.

Because the dial has a number of detentes over a range of rotational angles, the shipping case can accommodate turbine blade models having a range of root-to-chord angles. Further, because the foam pads compress to hold the blade edges, blades having a variety of chord distances from leading to trailing edge can be accommodated. The dial slot is capable of receiving different root profiles. Thus, the universal shipping case of the present invention can accommodate turbine blade models having a wide variety of root profiles, blade lengths, blade widths, and root-to-chord angles.

When the blade is ready to be removed, the technician need only open the case, grasp the turbine blade, rotate it approximately a quarter turn until the dial reaches its loading position, and slide the turbine blade out of the dial. Loading or unloading a pair of blades can be performed in less than thirty seconds.

In one aspect, the present invention comprises a universal turbine blade pair case assembly for turbine blades each having a root for mounting the turbine blade on a turbine engine, and an outwardly extending blade area having a leading blade edge and an opposite trailing blade edge defining a transverse chord at an angle relative to the root, the assembly having the following components: a housing including a base portion and a lid portion for securing to the base portion, the housing having first and second longitudinally extending spaces for holding first and second turbine blades, each longitudinally extending space having an end where the retainer is mounted and an opposite end; a pair of rotatable turbine blade root retainers, rotatably mounted within the housing, with one of the retainers being mounted at one end of the first longitudinally extending space and the other retainer being mounted at one end of the second longitudinally extending space, each retainer having a transverse slot for receiving the root of a turbine blade; and a cushioned support at the end of each of the longitudinally extending spaces opposite from the end where the retainer is mounted, whereby pairs of turbine blades may be mounted together in the case assembly and protected against damage during storage or transport of said turbine blades.

The above-described objects of the present invention and other features and benefits of the present invention will become clear to those skilled in the art when read in conjunction with the following detailed description of a preferred illustrative embodiment and viewed in conjunction with the attached drawings and appended claims.

BRIEF DESCRIPTION OF THE DRAWINGS

FIG. 3 is a fragmentary perspective view of the turbine blade case assembly and blade of FIG. 1;

FIG. 4 is a front elevation view of root retainer dial;

FIG. 5 is a partial sectional view of the root retainer dial of FIG. 4;

DETAILED DESCRIPTION OF THE PREFERRED EMBODIMENTS

Figure 1:
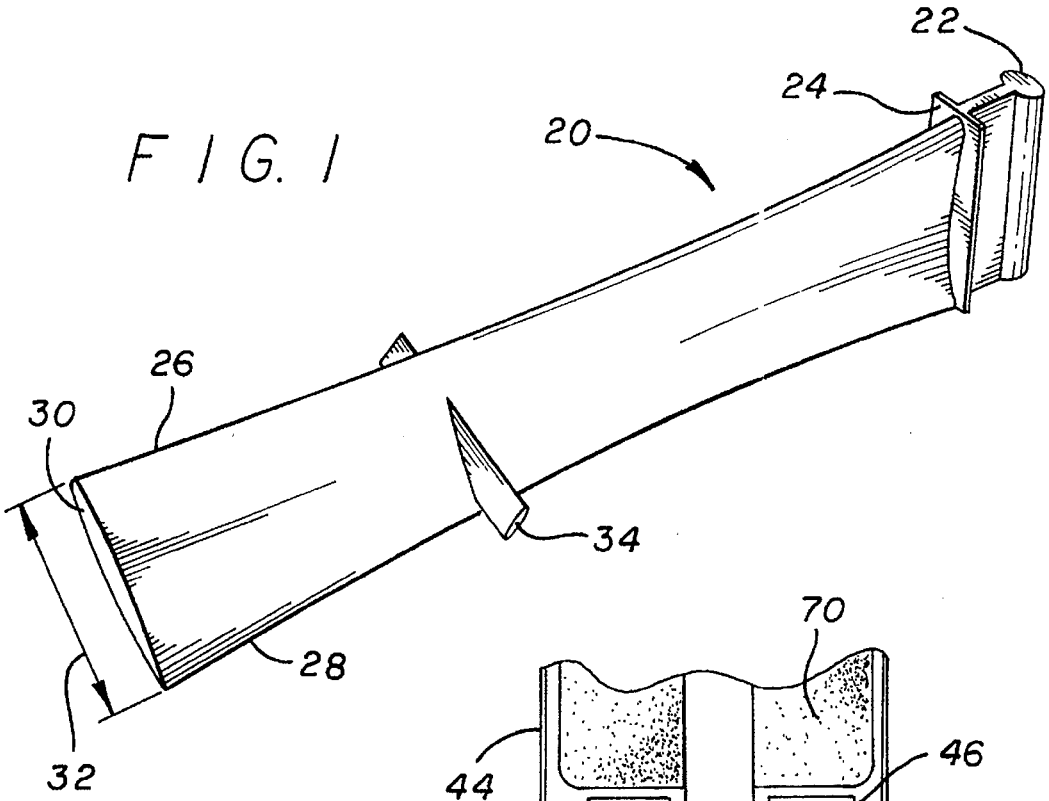
FIG. 1 is a perspective view of a typical fan blade.

FIG. 1 depicts a typical turbine fan blade. The fan blade 20 includes a root 22 by which the blade is held in a jet engine (not shown) as fan blade 20 rotates. Immediately above root 22 is platform 24, from which the blade area extends outwardly. A leading edge 26 and a trailing edge 28 at tip 30 define a transverse chord 32. Blade 20 typically also includes one or more pairs of midspans 34. The chord is at an angle with respect to the root, typically about 45 degrees.

Figure 2:
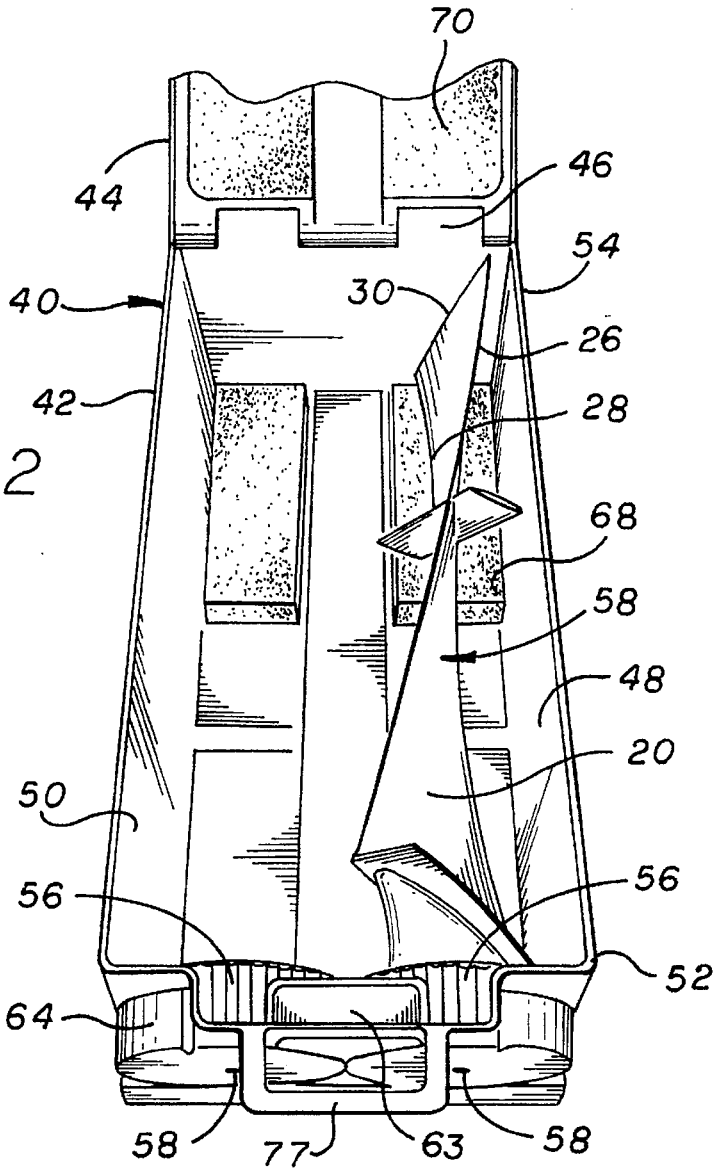
FIG. 2 is a top perspective view of a turbine blade case assembly according to an illustrative embodiment of the present invention, shown with a single turbine fan blade mounted therein.

Referring now to FIG. 2, a universal turbine fan blade pair case assembly according to an illustrative embodiment of the present invention includes a housing 40 having a base portion 42 and a lid portion 44 hinged together at hinge 46. It has been found that a housing 40 having overall dimensions of 35 inches (89 cm) long by 16 inches (41 cm) wide by 12 inches (30 cm) deep is suitable for enclosing most turbine blades. Housing 40 is preferably formed of cross-linked polyethylene for durability, with base and lid hinge halves being molded integral with base portion 42 and lid portion 44, respectively. A hinge pin (not shown) completes the hinge. Although housing 40 is hinged in the preferred embodiment, alternatively base 42 and lid 44 could be clamped together by fasteners at both ends of housing 40, without any hinge. Housing 40 is partitioned into first and second longitudinally extending spaces 48 and 50 for holding a first and a second turbine blade. Housing 40 has a root end 52 and a tip end 54 in the preferred illustrative embodiment, although the case assembly could alternatively be constructed with the root of one blade and the tip of the other blade mounted at the same end of the assembly. Two root retainers or dials 56 are rotatably mounted to root end 52 within base 42 via mounting bolts 58, clevis pins, or the like. Each dial 56 has a transverse slot 60 (FIG. 3). When slot 60 is aligned vertically defining a loading position, slot end 62 is exposed such that the root 22 (FIG. 1) of a turbine blade 20 may be slidably received into dial 56. Slot 60 has a non-uniform cross section defined by tapered or stepped neck 65 (FIG. 5) with a reduced cross-section at the mouth of the slot 60, so as to retain root 22 within slot 60 against longitudinal movement of blade 20 within housing 40. When root 22 has been slid into slot 60, blade 20 is rotated by hand until blade tip 30 is aligned substantially vertically. At that point, slot 60 will be no longer vertical, but will rather be at angle to the vertical that equals the fan blade's root-to-chord angle, which is typically on the order of 45°. A dial 56 (FIG. 5) having circumference of 7 inches (18 cm) and slot 60 with minimum neck width 100 of 0.875 inch (2.25 cm), slot width 102 of 1.5 inches (3.8 cm), and slot depth 104 of 1.5 inches (3.8 cm), has been found to be capable of holding a wide range of turbine blade roots, including American made blades having the root profile substantially as shown in FIG. 1, as well as European made blades having a "Christmas tree" shaped root profile. For reasons of economy and weight, dial 56 has a first hollow space 88 and a second hollow space (not shown) molded therein. Slot end 62 (FIG. 3), having been rotated approximately 45°, will now be covered by a first slot cap 63 which is molded integral with base 42. Slot end 62 being covered by slot cap 63 defines a stow position, in which root 22 is positively retained within dial 56. A second slot cap 64 (FIG. 2) is provided such that rotation of dial 56 from its loading position in either the plus angle or minus angle direction will result in a stow configuration, to accommodate fan blades having either positive or negative root-to-chord angles. In the preferred embodiment, slot caps 63 and 64 are defined by a circular recess in base 42 in which dial 56 resides. A plurality of detentes 66 engage corresponding protrusions on slot cap 64 or any other suitable part of housing 40 to engage dial 56 in locking frictional engagement, such that dial 56 cannot rotate from a stow position to a loading position by itself without human intervention. Detentes 66 are positioned on dial 56 in predetermined positions corresponding to known and reasonably anticipated root-to-chord angles. When blade tip 30 is aligned vertically, trailing edge 28 rests on a first cushioned support 68 mounted to tip end 54 of base 42 (FIG. 2). First cushioned support 68 may be a resilient pad such as foam, rubber, or other suitable cushioning material. A second and similar cushioned support 70 is mounted to lid 44 such that when lid 44 is closed down onto base 42, trailing edge 28 and leading edge 26 are firmly but gently held by cushioned supports 68 and 70. In the preferred embodiment foam pads 68 and 70 (FIG. 3) are made of gray ether 1.9 lb. grade 90 I.L.D. polyurethane foam, with dimensions of 12 inches (30 cm) long by 4-¼ inches (11 cm) wide by 2 inches (5 cm) deep. With lid 44 closed and turbine blade edges 26 and 28 held between foam pads 68 and 70, turbine blade 20 and its matching blade (not shown) may be safely shipped or stored within the turbine blade case assembly.

As a feature of the present invention, the turbine blade case assembly is adapted to hold a wide variety of turbine blade models. The assembly is sufficiently long so as to hold various lengths of turbine blades. Cushioned supports 68 and 70 may be fashioned from soft resilient material such as foam rubber, so as to accommodate turbine blades having a variety of chord distances 32. The shape of slot 60 is chosen so as to be able to receive yet positively retain a variety of root profiles. Because dial 56 includes a number of detentes 66 spaced at various angles around the circumference of dial 56, dial 56 will lock at any one of a number of rotational angles. Hence, the assembly is capable of holding turbine blades having a variety of root-to-chord angles. From the foregoing, it is apparent that the turbine blade case assembly of the present invention is a universal turbine blade case assembly, capable of securely and safely holding a wide variety of matched pairs of jet engine turbine fan blades for shipping and storage.

Figure 6:
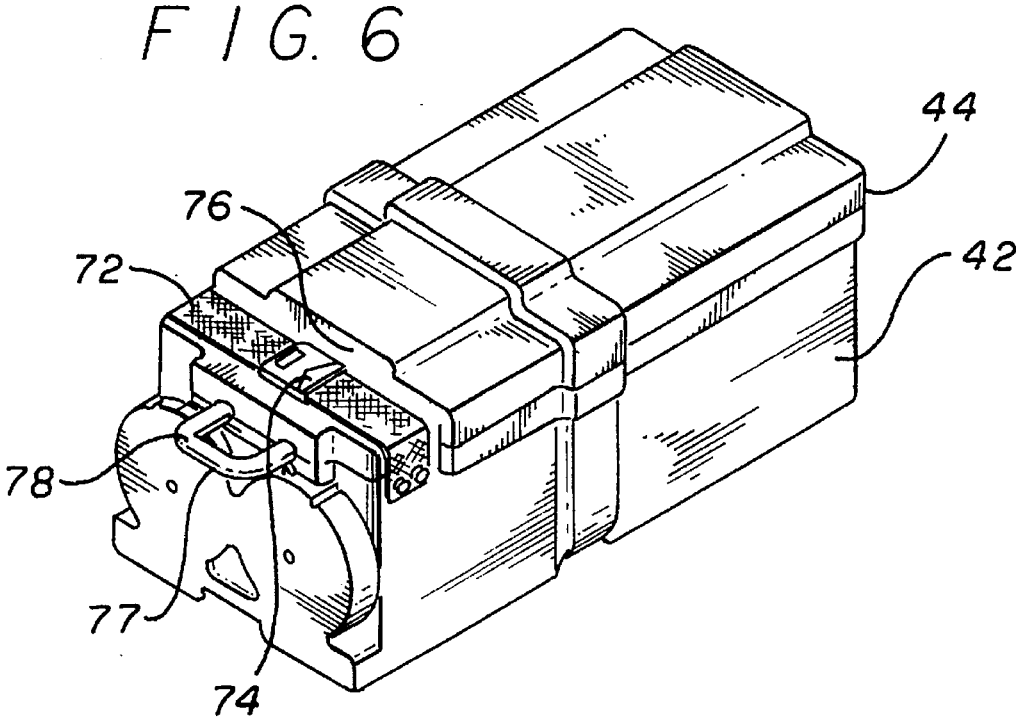
FIG. 6 is a perspective view of a universal turbine blade pair case assembly according to the present invention, as viewed from the root end.

Additional features of the present invention are visible in FIG. 6, which illustrates the turbine fan blade case assembly of the present invention in its closed position. A closure comprising a strap 72 is attached to either side of base 42, extends over lid 44 within a strap recess 76, and closes via a buckle 74 to firmly hold the assembly closed. In the preferred embodiment, strap 72 is comprised of two-inch nylon webbing, and buckle 74 is a LOCK MONSTER™ buckle available from Owen Mills, Van Nuys, Calif. Buckle 74 may be fixed, or may be an adjustable buckle such that strap 72 may be cinched down on top of lid 44 within recess 76. Any number of other fastening means well known in the art could alternatively be used to ensure that the assembly stays closed during shipping and handling. A handle comprising a base handle half 77 and a lid handle half 78 molded integral with base 42 and lid 44, respectively, allow the entire assembly to be easily carried by its heaviest portion when loaded while additionally ensuring that the assembly cannot accidentally fly open while being carried.

Figure 7:
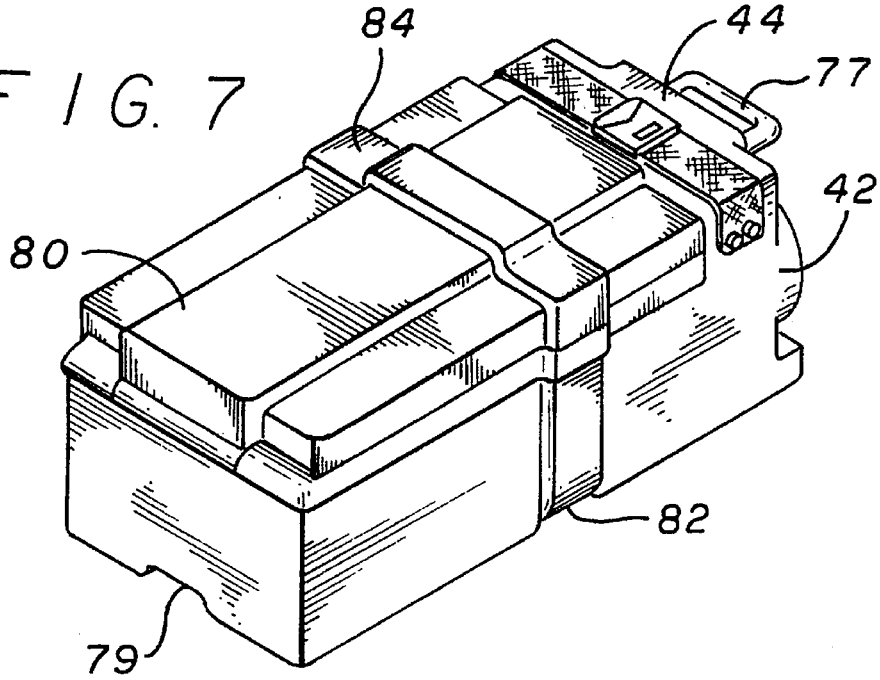
FIG. 7 is a perspective view of the turbine blade case of FIG. 6, as viewed from the tip end.
Figure 8:
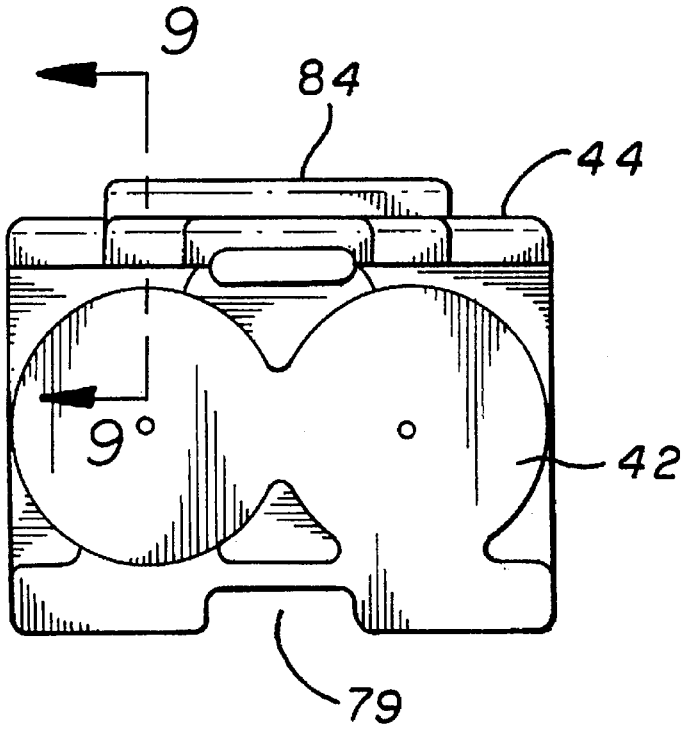
FIG. 8 is a side elevation view of the turbine blade case of FIG. 6, viewed from the root end.
Figure 9:
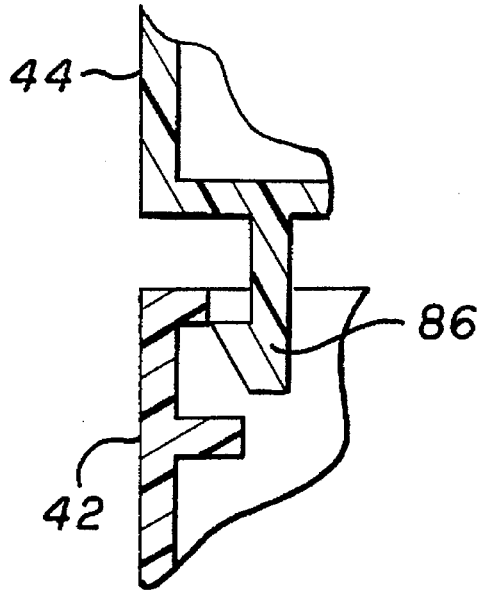
FIG. 9 is a fragmentary sectional view of the turbine blade case of FIG. 8.

Referring now to FIG. 7, the assembly also has an upwardly extending longitudinal impression 79 in base 42 that defines a longitudinal partition between first and second longitudinal spaces within the housing for first and second turbine blades, thus preventing the turbine blades from contacting each other during transit. Impression 79 of a first assembly mates with corresponding and substantially similar upwardly extending longitudinal impression 80 in lid 44 of a second assembly so as to prevent transverse movement of one assembly relative to another when multiple assemblies are stacked. Base 42 also has an upwardly extending transverse impression 82 that mates with a corresponding upwardly extending transverse impression 84 in lid 44 so as to prevent longitudinal movement of one assembly relative to another when multiple assemblies are stacked. Thus, the assemblies are provided with both transverse and longitudinal stacking stability. Safety catch 86 (FIG. 9) is also molded integral with lid 44 and base 42 for further protection against the assembly accidentally opening. As additional advantages of the present invention, the molded construction provides for economical manufacture, and there are no removable parts that can be lost.

Having presented one preferred illustrative embodiment of the present invention, various alternatives which are also contemplated as being within the scope of the invention will now be discussed. These alternatives are by no means exhaustive, as these and many others will become apparent to those skilled in the art.

Although the root retainers or dials 56 (FIG. 5) are configured to receive fan blades having various root profiles, it may be necessary in some circumstances to provide a root adapter (not shown) that slips over a turbine blade root 22 and into dial 56 if a root 22 has a profile that is exceptionally small or otherwise unusually shaped.

As an alternative to top cushioned support 70 (FIG. 3) which closes down on blade 20 when lid 44 is closed down onto base 42, an elastic loop, fabric strap, or various other means could be clamped over leading edge 26 of blade 20 to hold blade 20 securely down against bottom cushioned support 68 independent of lid 44. Although top and bottom cushioned supports 68 and 70, which comprise resilient pads in the preferred embodiment, are capable of holding blades having various chord distances due to the resilient nature of the pads, it may be necessary or desirable in some cases to make pads 68 and/or 70 removable, such that the pads can be replaced with thicker or thinner pads, or simply replaced when worn out. Replaceable pads can be provided if desired by providing for an interference fit between the pads and molded ridges within housing base 42 and lid 44, by fastening the pads to the base 42 and lid 44 by hook and pile fasteners, or by various other means. It is also not necessary that a slot cap 64 (FIG. 3) that is molded integral with base 42 be provided as in the preferred embodiment. Any mechanism by which the blade root is retained securely within dial 56 will suffice. Additionally, various other clamping and locking mechanisms well known to those skilled in the art could be substituted for detentes 66 to ensure that dial 66 does not accidentally rotate from a stow to a loading position.

Although the present invention has thus been described in detail with regard to the preferred embodiments and drawings thereof, it should be apparent to those skilled in the art that various adaptations and modifications of the present invention may be accomplished without departing from the spirit and the scope of the invention. Thus, by way of example and not of limitation, the root retainers, instead of being pivotally mounted, could each be provided with VELCRO™ type hook and loop fasteners, with the hook portions on the retainers and the loop portions on the end wall of the housing, for holding each turbine blade in the desired angular orientation. Accordingly, it is to be understood that the detailed description and the accompanying drawings as set forth hereinabove are not intended to limit the breadth of the present invention, which should be inferred only from the following claims and their appropriately construed legal equivalents.

What is claimed is:

1. A universal turbine blade pair case assembly for turbine blades, each turbine blade having a root for mounting the turbine blade on a turbine engine, and an outwardly extending blade area having a leading blade edge and an opposite trailing blade edge, the opposite edges defining a transverse chord at an angle relative to the root, said assembly comprising:

a housing including a base portion and a lid portion for securing to said base portion, said housing having first and second longitudinally extending spaces for holding first and second turbine blades, each longitudinally extending space having a first end and an opposite end;

a pair of rotatable turbine blade root retainers, rotatably mounted within said housing, with one of said retainers being mounted at the first end of the first longitudinally extending space and the other retainer being mounted at the first end of the second longitudinally extending space;

each said retainer having a transverse slot for receiving the root of a turbine blade; and a cushioned support disposed at the end of each of said longitudinally extending spaces opposite from the end where the retainer is mounted;

whereby pairs of turbine blades may be mounted together in said case assembly and protected against damage during storage or transport of said turbine blades.

2. A universal turbine blade pair case assembly as defined in claim 1 wherein each retainer slot has a non-uniform cross section for retaining a turbine blade root.

3. A universal turbine blade pair case assembly as defined in claim 2 wherein each of said cushioned supports comprises:

a pair of resilient pads with one pad mounted to said housing lid portion and the other pad mounted to said housing base portion to engage said opposite blade edges when the root of the turbine blade is mounted in said slot in said retainer.

4. A universal turbine blade pair case assembly as defined in claim 3 wherein said turbine blade root retainers are rotatably lockable such that a turbine blade retained within a retainer may be rotatably locked with the turbine blade chord in a substantially vertical position.

5. A universal turbine blade pair case assembly as defined in claim 4 wherein detentes are provided for locking said retainers at predetermined angular orientations.

6. A universal turbine blade pair case assembly as defined in claim 5 wherein:

for each said transverse retainer slot, the slot having an open slot end, the slot may be rotated to a substantially vertical position defining a loading position wherein said slot end is exposed, such that a turbine blade root may be slidably engaged into and out of said slot through said slot end; and wherein the assembly further comprises:

a pair of slot caps, each slot cap covering a portion of respective said retainers, such that when each said retainer is in its loading position the slot end is exposed for receiving a turbine blade root, and when each retainer is rotated from its loading position to a stow position the slot cap covers the slot end thereby positively retaining the turbine blade root within the retainer.

7. A universal turbine blade pair case assembly as defined in claim 6 wherein:

each said slot cap is defined by a respective recess in said housing base portion, with each retainer being at least partially fitted within a respective recess.

8. A universal turbine blade pair case assembly as defined in claim 7 wherein:

said detentes are provided on said retainers, the detentes interferingly engaging protrusions molded integral to said housing base portion, such that the retainers may be rotatably locked in predetermined positions.

9. A universal turbine blade pair case assembly as defined in claim 8 further comprising:

a longitudinal partition defining said first and second longitudinally extending spaces within said housing.

10. A universal turbine blade pair case assembly as defined in claim 9 wherein:

said longitudinal partition is defined by an upwardly extending longitudinal impression in said housing base portion; and said lid portion has an upwardly extending longitudinal impression substantially similar to said upwardly extending longitudinal impression in said housing base portion;

such that the base portion longitudinal impression of a first assembly mates with the lid portion longitudinal impression of a second assembly to provide transverse stacking stability.

11. A universal turbine blade pair case assembly as defined in claim 10 wherein:

said base portion includes an upwardly extending transverse impression;

said lid portion includes an upwardly extending transverse impression substantially similar to said upwardly extending transverse impression in said base portion;

such that the base portion transverse impression of a first assembly mates with the lid portion transverse impression of a second assembly to provide longitudinal stacking stability.

12. A universal turbine blade pair case assembly as defined in claim 11 wherein:

the non-uniform cross section of each said retainer slot defines a reduced cross-section disposed toward the interior of said housing relative to said retainer.

13. A universal turbine blade pair case assembly as defined in claim 12 wherein said lid portion has a strap recess, the assembly further comprising:

a strap affixed to said base portion and passing over said base portion within said strap recess to securely hold said lid portion closed against said base portion.

14. A universal turbine blade pair case assembly as defined in claim 13 further comprising:

a handle mounted on the assembly at said end at which at least one of said retainers is mounted, said handle comprising a first handle element affixed to said lid portion and a second handle element affixed to said base portion, such that when the assembly is carried by the handle the two handle portions are held together.

15. A universal turbine blade pair case assembly for protecting turbine blade pairs from damage during shipping and storage, each turbine blade having a root for mounting the turbine blade on a turbine engine, and an outwardly extending blade area having a leading blade edge and an opposite trailing blade edge, the opposite edges defining a transverse chord at an angle relative to the root, said assembly comprising:

a housing including a base portion and a lid portion for securing to said base portion, said housing having first and second longitudinally extending spaces for holding first and second turbine blades, each longitudinally extending space having a first end and an opposite end;

a pair of turbine blade root retainers, with one of said retainers being located at the first end of the first longitudinally extending space and the other retainer being located at the first end of the second longitudinally extending space;

each said retainer having a slot for receiving the root of a turbine blade; and a turbine blade support disposed at the end of each of said longitudinally extending spaces opposite from the end where the retainer is located.

16. A universal turbine pair blade pair case assembly for turbine blades, each turbine blade having a root for mounting the turbine blade and an outwardly extending blade area having opposite blade edges defining a transverse chord at an angle relative to the root, said assembly comprising:

an elongated housing including a base portion and a lid portion for securing to said base portion, said housing being longitudinally partitioned to provide first and second longitudinally extending spaces for holding first and second turbine blades;

a pair of turbine blade root retainers, mounted at one end of said housing, with one of said retainers being mounted at one end of the first one of said longitudinally extending spaces and the other retainer being mounted at one end of the second of said longitudinally extending spaces, each said retainer having a transverse slot of non-uniform cross section for receiving and positively retaining the root of a turbine blade; and a pair of resilient pads mounted within said housing at the ends of each of said longitudinally extending spaces opposite from the end where the retainer is mounted, with one pad mounted to said lid portion and the other pad mounted to said base portion to engage said opposite edges of the turbine blade when the root of the turbine blade is mounted in said slot in said retainer;

whereby pairs of turbine blades may be mounted together in said case assembly and protected against damage during storage or transport of said turbine blades.

17. A universal turbine blade pair case assembly as defined in claim 16 wherein each said retainer rotatably retains a turbine blade root.

18. A universal turbine blade pair case assembly as defined in claim 17 wherein each said retainer rotatably locks at predetermined rotation angles.

* * * * *